US009120978B2

(12) United States Patent
Mazyar et al.

(10) Patent No.: US 9,120,978 B2
(45) Date of Patent: Sep. 1, 2015

(54) EXFOLIATION OF ASPHALTENES FOR IMPROVED RECOVERY OF UNCONVENTIONAL OILS

(75) Inventors: Oleg A. Mazyar, Houston, TX (US); Houman M. Shammai, Houston, TX (US); Gaurav Agrawal, Aurora, CO (US)

(73) Assignee: Baker Hughes Incorporated, Houston, TX (US)

( * ) Notice: Subject to any disclaimer, the term of this patent is extended or adjusted under 35 U.S.C. 154(b) by 192 days.

(21) Appl. No.: 13/404,858

(22) Filed: Feb. 24, 2012

(65) Prior Publication Data

US 2013/0220883 A1 Aug. 29, 2013

(51) Int. Cl.
*C10C 3/02* (2006.01)
*C10G 1/04* (2006.01)

(52) U.S. Cl.
CPC ..... *C10G 1/045* (2013.01)

(58) Field of Classification Search
CPC ..... C10C 3/02; C10C 3/023
USPC ..... 208/6, 44–45, 309
See application file for complete search history.

(56) References Cited

U.S. PATENT DOCUMENTS

| | | | | |
|---|---|---|---|---|
| 2,970,099 | A * | 1/1961 | Illman | 208/23 |
| 3,975,396 | A * | 8/1976 | Bushnell et al. | 208/309 |
| 4,096,914 | A | 6/1978 | McLaughlin et al. | |
| 4,124,486 | A * | 11/1978 | Nolley, Jr. | 208/95 |
| 4,422,926 | A | 12/1983 | Gould et al. | |
| 4,440,633 | A * | 4/1984 | Jacquin et al. | 204/158.21 |
| 4,493,765 | A * | 1/1985 | Long et al. | 208/309 |
| 4,752,382 | A * | 6/1988 | Eidem | 208/309 |
| 4,846,957 | A * | 7/1989 | Johnson et al. | 208/86 |
| 4,946,892 | A | 8/1990 | Chung | |
| 5,055,179 | A | 10/1991 | Tyrer | |
| 5,110,443 | A | 5/1992 | Gregoli et al. | |
| 5,228,977 | A * | 7/1993 | Moran et al. | 208/44 |
| 6,048,904 | A | 4/2000 | Wiehe et al. | |
| 6,220,352 | B1 | 4/2001 | Walton | |
| 6,274,030 | B1 | 8/2001 | Wallace et al. | |
| 2006/0241237 | A1 | 10/2006 | Drzal et al. | |
| 2007/0092432 | A1 | 4/2007 | Prud'Homme et al. | |
| 2007/0284283 | A1 * | 12/2007 | Duyvesteyn et al. | 208/4 |

(Continued)

FOREIGN PATENT DOCUMENTS

WO 2008157209 A1 12/2008

OTHER PUBLICATIONS

Goual, L. et al. (2004). AIChE Journal, 50(2), 470-479.*

(Continued)

*Primary Examiner* — Brian McCaig
(74) *Attorney, Agent, or Firm* — Cantor Colburn LLP

(57) ABSTRACT

A method for decomposing an asphaltene particle includes contacting the asphaltene particle with an intercalating agent and separating an asphaltene molecule from the asphaltene particle to decompose the asphaltene particle. Dispersing an asphaltene particle includes functionalizing the asphaltene particle and contacting the asphaltene particle with a solvent to disperse the asphaltene particle. Such asphaltene particle decomposition and dispersal can be used in a method for improving oil recovery that includes disposing a reagent in an oil environment; contacting an asphaltene particle with the reagent; decomposing the asphaltene particle to produce decomposed asphaltene; and displacing the decomposed asphaltene to improve oil recovery.

21 Claims, 1 Drawing Sheet

(56) References Cited

U.S. PATENT DOCUMENTS

| | | | |
|---|---|---|---|
| 2008/0020949 | A1 | 1/2008 | Trimble et al. |
| 2009/0054581 | A1 | 2/2009 | Prud'Homme et al. |
| 2009/0134059 | A1 | 5/2009 | Myers et al. |
| 2011/0079748 | A1 | 4/2011 | Ruoff et al. |

OTHER PUBLICATIONS

Li, S. et al. (1997). Fuel, 76(14/15), 1459-1463.*
Banerjee, D.K. (2012). Oil Sands, Heavy Oil & Bitumen: From Recovery to Refinery, Pennwell, 208 pgs [Office action references p. 19].*
Alexander A. Green et al., "Solution Phase Production of Graphene with Controlled Thickness via Density Differentiation," Nano Lett., 2009, vol. 9, No. 12, pp. 4031-4036.
Athanasios B. Bourlinos et al., "Liquid-Phase Exfoliation of Graphite Towards Solubilized Graphenes," Small 2009, 5, No. 16, pp. 1841-1845.
Graeme Williams et al., "TiO2-Graphene Nanocomposites. UV-Assisted Photocatalytic Reduction of Graphene Oxide," ACS NANO, 2008, vol. 2, No. 7, pp. 1487-1491.
Jay R. Lomeda et al., "Diazonium Functionalization of Surfactant-Wrapped Chemically Converted Graphene Sheets," J. Am. Chem. Soc.; 2008, 130, pp. 16201-16206.
K.S. Novoselov et al., "Two-dimensional atomic crystals," PNAS; Jul. 26, 2005, pp. 10451-10453, vol. 102, No. 30.
K.S. Novoselov et al., "Electric Field Effect in Atomically Thin Carbon Films," Science, 2004, pp. 666-669, vol. 306.
Mustafa Lotya et al., "Liquid Phase Production of Graphene by Exfoliation of Graphite in Surfactant/Water Solutions," J. Am. .Chem. Soc. 2009, vol. 131, No. 10, pp. 3611-3620.
Peter Blake et al., "Graphene-Based Liquid Crystal Device," Nano Letters, 2008, vol. 8, No. 6, pp. 1704-1708.
Sasha Stankovich et al., "Synthesis and exfoliation of isocyanate-treated graphene oxide nanoplatelets," Carbon 44 (2006), pp. 3342-3347.
Sasha Stankovich et al., "Synthesis of graphene-based nanosheets via chemical reduction of exfoliated graphite oxide," Carbon 45 (2007), pp. 1558-1565.
Umar Khan et al., "High-Concentration Solvent Exfoliation of Graphene," Small, 2010, 6, No. 7, pp. 864-871.
Vincent C. Tung et al., "High-throughput solution processing of large-scale graphene," Nature Nanotechnology, vol. 4, Jan. 2009, www.nature.com/naturenanotechnology, pp. 25-29.
Yenny Hernandez et al., "High-yield production of graphene by liquid-phase exfoliation of graphite," Nature Nanotechnology, vol. 3, Sep. 2008, pp. 563-568.
Zhihong Tang et al., "Exfoliation of Graphene from Graphite and Their Self-Assembly at the Oil-Water Interface," Langmuir, 2010, 26 (11), pp. 9045-9049.
Charles Allan Brown, "Potassium Hydride, a Highly Active New Hydride Reagent. Reactivity, Applictaions, and Techniques in Organic and Organometallic Reactions 1-3," J. Org. Chem., vol. 39, No. 26, 1974, pp. 3913-3917.
Jean Melin et al., "Thermal Stability and Structure of Graphite-Antimony Pentachloride Compounds," Carbon, 1975, vol. 13, pp. 357-362.
New Mexico Tech, [online]; [retrieved on Jul. 19, 2012]; retrieved from the Internet http://baervan.nmt.edu/Petrophysics/group/intro-2-asphaltenes.pdf, "What are asphaltenes?," 13p.
Ronald J. Gillespie et al., "Reactions of S3N3F3 and S3N3CI3 with Lewis Acids, Preparation and Crystal Structure of Pentathiazyl Hexachloroantimonate, (S5N5) (SbCI6)," Inorg. Chem. 1982, 21, 1296-1302, pp. 1296-1302.
Toshiaki Enoki et al., Graphite Intercalation Compounds and Applications, Synthesis and Intercalation Chemistry, Oxford Unversity Press, 2003, pp. 30-39.
Toshiaki Enoki et al., Graphite Intercalation Compounds and Applications, Synthesis and Intercalation Chemistry, Oxford Unversity Press, pp. 16-19.
International Preliminary Report on Patentability for related PCT Application No. PCT/US2013/022092, Apr. 29, 2013, pp. 1-7.
International Search Report for related PCT Application No. PCT/US2013/022092, Apr. 29, 2013, pp. 1-3.
International Search Report for related PCT Application No. PCT/US2013/041376, Aug. 13, 2013, pp. 1-3.
Written Opinion for related PCT Application No. PCT/US2013/022092, Apr. 29, 2013, pp. 1-5.

* cited by examiner

EXFOLIATION OF ASPHALTENES FOR IMPROVED RECOVERY OF UNCONVENTIONAL OILS

BACKGROUND

Asphaltenes are a major component in crude oil, and there is general agreement as to the deleterious effects of asphaltenes in the reduction of oil extraction and processing in the petrochemical industry. Asphaltenes may deposit in the pores of formations, blocking the flow of fluids. Additionally, asphaltenes can precipitate from a stream of oil and coat boreholes, production tubing, and transport lines. Moreover, in a processing facility, asphaltenes can foul processing equipment and poison catalysts.

Asphaltene molecules have been widely reported as having a fused polyaromatic ring system and containing sulfur, oxygen, and nitrogen heteroatoms. The heteroatoms may be part of the aromatic ring system or part of other carbocyclic rings, linking groups, or functional groups. Two structural motifs for asphaltene molecules are the so-called continental and archipelago structures. In the continental structure, alkyl chains connect to and branch from a central polyaromatic ring system, which is believed to contain several fused aromatic rings, e.g. 10 or more aromatic rings. In the archipelago structure, multiple polyaromatic ring systems are connected by alkyl chains that may contain a heteroatom, and additional alkyl chains extend freely from the polyaromatic rings. The number of fused aromatic rings in the continental structure can be greater than the number of fused aromatic rings in the archipelago structure.

In addition to the aromatic regions of the asphaltenes, heteroatoms provide the asphaltenes with polar regions, and the terminal alkyl chains provide hydrophobic regions. Consequently, it is believed that asphaltene molecules aggregate into various micellular structures in oil, with the alkyl chains interacting with the aliphatic oil components. Resin from the oil can insert between aromatic planes of neighboring asphaltene molecules in asphaltene aggregates, aiding in maintaining their micellular structure. Asphaltenes can precipitate from oil in structures where asphaltene molecules form stacked layers having aligned aromatic regions and aligned aliphatic regions.

Materials and methods for the removal of asphaltenes from oil environments would be well received in the art.

BRIEF DESCRIPTION

The above and other deficiencies of the prior art are overcome by, in an embodiment, a method for decomposing an asphaltene particle comprising: contacting the asphaltene particle with an intercalating agent; and separating an asphaltene molecule from the asphaltene particle to decompose the asphaltene particle.

In another embodiment, a method for dispersing an asphaltene particle comprises functionalizing the asphaltene; and contacting the asphaltene particle with a solvent to disperse the asphaltene particle.

In an embodiment, a method for improving oil recovery comprises disposing a reagent in an oil environment; contacting an asphaltene particle with the reagent; decomposing the asphaltene particle to produce decomposed asphaltene; and displacing the decomposed asphaltene to improve oil recovery.

BRIEF DESCRIPTION OF THE DRAWINGS

The following descriptions should not be considered limiting in any way. With reference to the accompanying drawings, like elements are numbered alike.

DETAILED DESCRIPTION

Figure 1A:
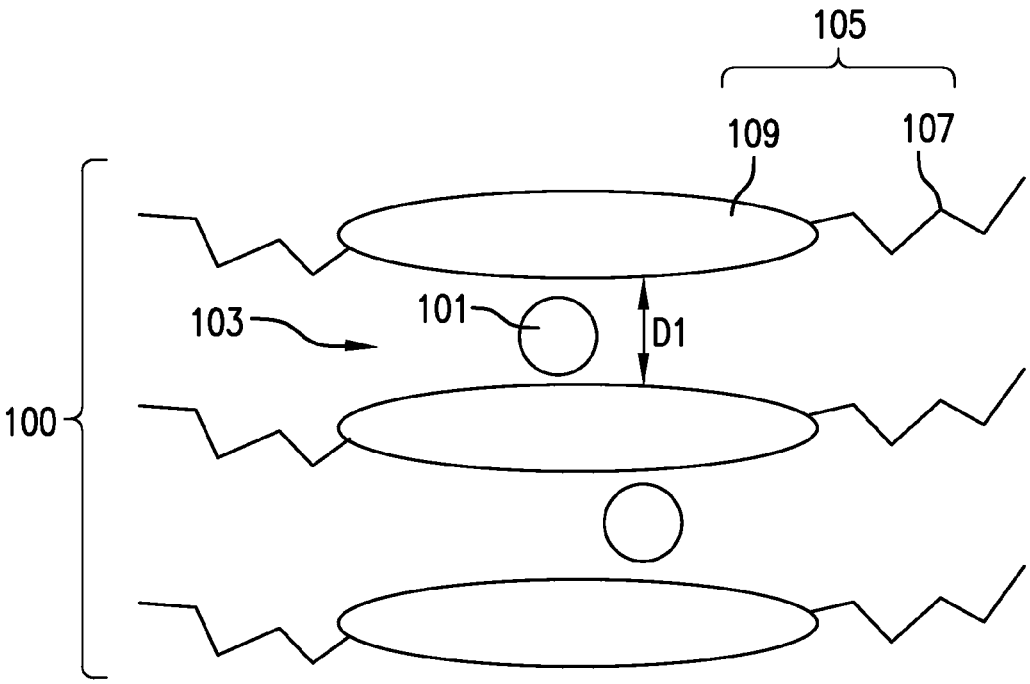
FIG. 1A shows an asphaltene particle with an intercalating agent disposed in a gallery of asphaltene molecules.

A detailed description of one or more embodiments of the disclosed material and method are presented herein by way of exemplification and not limitation with reference to the Figures.

It has been found that removal of asphaltene from pores of a rock formation, within a reservoir, or from a sidewall of a tubular, production tubing, borehole, or transportation tube can improve the permeability of such structures, leading to increased or prolonged lifetime for oil production. Moreover, perturbing the internal structure of asphaltene particles, for example, in a micelle or other aggregate, can lead to improvement of the production of petroleum fluid in a downhole or subsurface environment.

An asphaltene particle includes any collection of asphaltene molecules, for example, a micelle, precipitate, layered asphaltene molecules, aggregate, cluster, and the like. Interactions among the asphaltene molecules in an asphaltene particle may include hydrogen bonding, dipole-dipole interactions, and $\pi$-$\pi$ interactions. Without wishing to be bound by theory, disruption of these interactions can lead to exfoliation of an asphaltene molecule from the asphaltene particle. The methods herein are applicable to downhole as well as to ground environments.

In an embodiment, a method for decomposing an asphaltene particle includes contacting the asphaltene particle with an intercalating agent and separating an asphaltene molecule from the asphaltene particle to decompose the asphaltene particle. The intercalating agent can be disposed in the gallery between adjacent asphaltene molecules or disposed at the periphery of an asphaltene molecule such as proximate to an edge of an aromatic plane or terminal chain attached to an aromatic portion of an asphaltene molecule in the asphaltene particle.

In a non-limiting embodiment, decomposing the asphaltene particle further includes expanding the volume of the asphaltene particle. Volumetric expansion can decrease the interaction energy among the asphaltene molecules in the asphaltene particle, which can make it easier to remove an asphaltene molecule from the asphaltene particle. Volume expansion can occur, for example, due to the thermal expansion of the asphaltene particle such as by heating the asphaltene particle. In addition, the expansion can occur by introduction of an intercalating agent between adjacent asphaltene molecules. In one embodiment, the intercalating agent can be activated to produce additional particles (e.g., atoms or molecules) that increase the volume between the asphaltene molecules. The activation can be, for example, a unimolecular decomposition reaction of the intercalating agent. In another embodiment, the volume expansion occurs due to a reaction among components of the intercalating agent such as a bimolecular reaction that produces, for example, a gas, which can distort the spacing between asphaltene molecules in the asphaltene particle. In yet another embodiment, the intercalating agent in the gallery can react with an asphaltene molecule to produce a gas, which expands the inter-molecular separation among asphaltene molecules. During the volume expansion, the molecules in the gallery force the adjacent asphaltene molecules away from one another, thereby separating the asphaltene molecules. In this manner, an asphaltene molecule can be exfoliated from the asphaltene particle.

According to an embodiment, the method includes increasing the temperature of the asphaltene particle. Increasing the temperature includes techniques that can elevate the temperature to about 100° C. to about 1200° C., specifically about 100° C. to about 1000° C., and more specifically about 100° C. to about 800° C. Such techniques involve, for example, in-situ combustion, steam introduction, heated fluid injection, or a combination comprising at least one of the foregoing. In an embodiment, a downhole environment is heated by introducing steam in an injection well with the steam propagating through the formation and heating the asphaltene particles. The asphaltene particles are heated and can linearly expand, decreasing their mutual attraction. Depending on the amount of expansion of the asphaltene particle, asphaltene molecules can exfoliate from the asphaltene particles. In one embodiment, the heating of an intercalating agent associated with the asphaltene particle can lead to exfoliation of an asphaltene molecule therefrom.

Heated fluid injection can include heating a fluid (e.g., a solvent) and subsequently disposing the heated fluid downhole to increase the temperature of the asphaltene particles. In a non-limiting embodiment, in-situ combustion increases the temperature of the asphaltene particles by injecting a gas containing oxygen, for example air, downhole and igniting oil in the reservoir with concurrent combustion in the gas. The combustion releases heat, which can be absorbed by the asphaltene particle or intercalating agent in order to exfoliate an asphaltene molecule from the asphaltene particle.

In certain embodiments, the method further includes applying sonic frequencies to the asphaltene particle. The sonic frequencies can be from about 400 hertz (Hz) to about 400 megahertz (MHz), specifically about 800 Hz to about 350 MHz, and more specifically about 1 kilohertz (kHz) to about 300 MHz. A transducer placed near the asphaltene particle can produce the sonic frequency, which can destructively interact with the asphaltene particle or intercalating agent. Sonic frequencies may induce chemical reactions of the intercalating agent and disrupt interparticle bonding in the asphaltene particle, leading to exfoliation of an asphaltene molecule. The sonic frequencies can detach neighboring polyaromatic planes of adjacent asphaltene molecules. Without wishing to be bound by any particular theory, such deterioration of the asphaltene particle may be induced by short-lived, localized disturbances (e.g., a hot spot) produced by the implosion of bubbles in the course of acoustic cavitation.

Figure 1B:
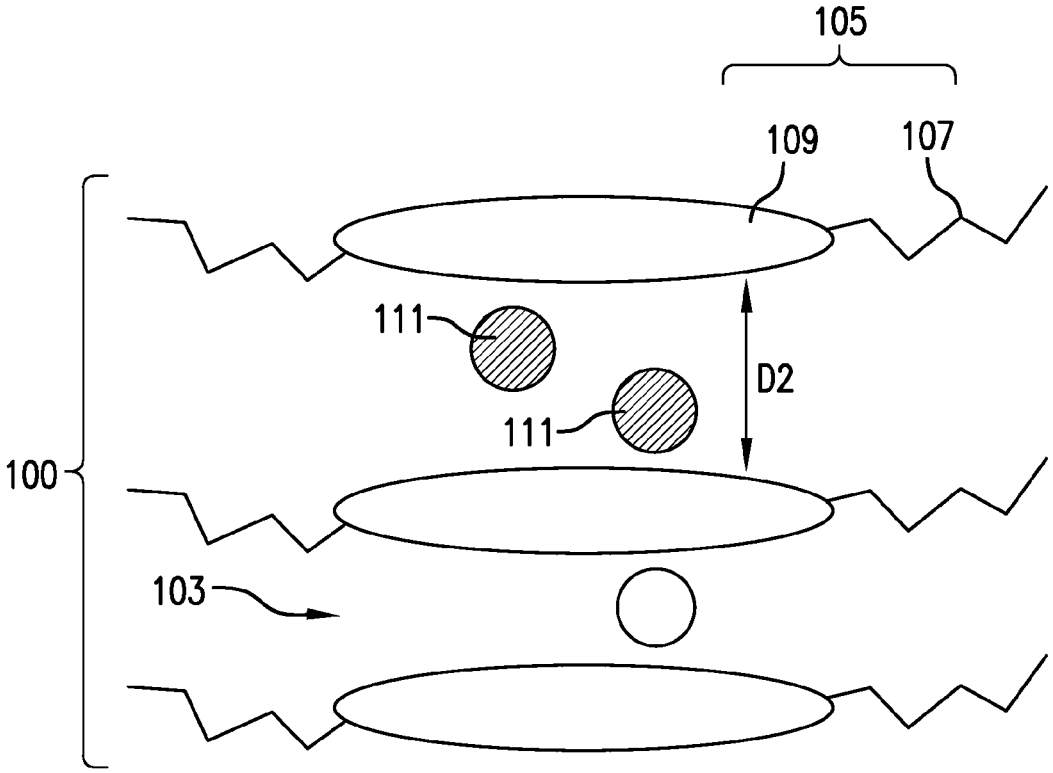
FIG. 1B shows an asphaltene particle with reaction products from an intercalating agent disposed in a gallery of asphaltene molecules.

As shown in FIG. 1A, in an embodiment, the intercalating agent 101 is disposed in the gallery 103 of adjacent asphaltene molecules 105 of an asphaltene particle 100. The asphaltene molecule 105 has an aliphatic tail 107 freely extending from a polyaromatic fused ring system 109. A distance D1 is the spacing between adjacent asphaltene molecules. As shown in FIG. 1B, the intercalating agent 101 can react to produce product atoms or molecules 111. Since more particles are produced from the reaction than the number of particles of the intercalating agent, the volume of the gallery 103 increases as the distance D2 between adjacent asphaltene molecules increases from distance D1. Since the resulting distance D2 is greater than the initial distance D1, the interaction energy among the asphaltene molecules decreases, leading to exfoliation of an asphaltene molecule. In an embodiment, the reaction of the intercalating agent can be facile so that the distance between adjacent asphaltene molecules increases abruptly to have an enhanced exfoliation rate. This can occur when, for example, gas is rapidly produced from the intercalating agent or from a functionalized asphaltene molecule (described more fully below).

Exfoliation of asphaltene molecules from asphaltene particles herein is carried out in various ways. In addition to the above, exemplary exfoliation methods include, but are not limited to, those which are used in graphite exfoliation to produce graphene and include fluorination, acid intercalation, acid intercalation followed by high temperature treatment, and the like, or a combination comprising at least one of the foregoing. Exfoliation of an asphaltene particle decreases the number of asphaltene molecules in the asphaltene particle. It will be appreciated that exfoliation of asphaltene particles may provide exfoliated asphaltene as a single asphaltene molecule, or as a micelle or layered particle containing fewer asphaltene molecules than the non-exfoliated asphaltene particle.

The intercalating agent can include, for example, an acid, metal, binary alloy of an alkali metal with mercury or thallium, ternary alloy of an alkali metal with a Group V metal (e.g., P, As, Sb, and Bi), metal chalcogenide (including metal oxides, metal sulfides, and metal selenides), metal peroxide, metal hyperoxide, metal hydride, metal hydroxide, metals coordinated by nitrogenous compounds, aromatic hydrocarbons (benzene, toluene), aliphatic hydrocarbons (methane, ethane, ethylene, acetylene, n-hexane) and their oxygen derivatives, halogen, fluoride, metal halide, nitrogenous compound, inorganic compound (e.g., trithiazyl trichloride, thionyl chloride), organometallic compound, oxidizing compound, solvent, or a combination comprising at least one of the foregoing. Exemplary acids include nitric acid, sulfuric acid, acetic acid, $CF_3COOH$, $HSO_3F$, $HSO_3Cl$, $HSO_3CF_3$, persulfuric acid (e.g., $H_2SO_5$, $H_2S_2O_8$), phosphoric acid, $H_4P_2O_7$, perchloric acid, $H_3AsO_4$, $H_2SeO_4$, $HIO_4$, $H_5IO_6$, $HAuCl_4$, $H_2PtCl_6$, or a combination comprising at least one of the foregoing. Exemplary metals include alkali metals (e.g., lithium, sodium, potassium, and the like), alkaline earth metals (e.g., magnesium, calcium, strontium, and the like), rare earth metals (e.g., scandium, yttrium, lanthanide elements, and the like), transition metals (e.g., iron, tungsten, vanadium, nickel, and the like), and post-transition metals (e.g., aluminum, tin, and the like). Exemplary metal halides include NaI, $FeCl_3$, $CuCl_2$, $AuCl_3$, $MoCl_5$, and the like. Nitrogenous compounds include, for example, ammonia, ammonium, hydrazines, amines, and amides. Exemplary halogens include $Cl_2$, $Br_2$, BrCl, ICl, IBr, $BrF_3$, $BrF_5$, and $IF_5$. Exemplary fluorides include halogen fluorides, boron fluoride, hydrogen fluoride, $PF_5$, $AsF_5$, and rare gas fluoride. Exemplary solvents include benzene, toluene, o-xylene, dimethyl sulfoxide, furan, tetrahydrofuran, o-dioxane, m-dioxane, p-dioxane, dimethoxyethane, n-methyl-pyrrolidone, n,n-dimethylacetamide, γ-butyrolactone, 1,3-dimethyl-2-imidazolidinone, benzyl benzoate, hexafluorobenzene, octafluorotoluene, pentafluorobenzonitrile, pentafluoropyridine, pyridine, dimethylformamide, hexamethylphosphoramide, nitromethane, and benzonitrile.

In an embodiment, the intercalating agent is $AuCl_3$. In an ensuing decomposition reaction of the intercalating agent within the gallery of adjacent asphaltene molecules, reaction products can be produced that include, for example, AuCl and $Cl_2$. The reaction produces a greater number of reaction products than the number of reagents, causing expansion of the gallery in the asphaltene particle. The asphaltene particle can be subjected to thermal treatment including heating the particle as above or to sonic (e.g., acoustic or ultrasound) frequencies to increase reactivity of the intercalating agent or the expansion rate of the gallery.

In another embodiment, the intercalating agent is an acid. In an embodiment, the acid is a combination of sulfuric acid and nitric acid and can also include an oxidizing agent such as potassium permanganate. Such acids lead to exfoliation of the asphaltene particle. In yet another embodiment, the intercalating agent is an oxidizing compound such as a peroxide, permanganate ion, chlorite ion, chlorate ion, perchlorate ion, hypochlorite ion, chromium trioxide, $PbO_2$, $MnO_2$, $As_2O_5$, $N_2O_5$, $CH_3ClO_4$, $(NH_4)_2S_2O_8$, chromate ion, dichromate ion, oxygen, fluorine, chlorine, or a combination comprising at least one of the foregoing.

In another embodiment, the intercalating agent is a solvent. Suitable solvents are those that have an interaction energy with asphaltene molecules that is at least as strong as the interaction energy among asphaltene molecules in an asphaltene particle that exhibits stacked asphaltene molecules. Exemplary solvents include n-methylpyrrolidone; n,n-dimethylacetamide; γ-butyrolactone; 1,3-dimethyl-2-imidazolidinone; benzyl benzoate; hexafluorobenzene; pyridine; hexafluorobenzene ($C_6F_6$); octafluorotoluene ($C_6F_5CF_3$); pentafluorobenzonitrile ($C_6F_5CN$); and pentafluoropyridine ($C_5F_5N$).

In certain embodiments, the intercalating agent is an organometallic compound that includes a metallocene, metal carbonyl, or a combination comprising at least one of the foregoing. According to one embodiment, the organometallic compound can decompose to form numerous reactant products. Such decomposition can cause expansion of the gallery of the asphaltene particles and exfoliation of asphaltene molecules.

As used herein "organometallic compound" refers to a compound that contains at least one bond between a metal and carbon atom in a neutral molecule, ion, or radical. In an embodiment, the organometallic compound contains a metal (e.g., a transition metal) with metal-carbon single bonds or metal-carbon multiple bonds as well as metal complexes with unsaturated molecules (metal-π-complexes). Examples of the organometallic compounds are sandwich compounds. Such sandwich compounds include full sandwiches, half sandwiches, multidecker sandwiches such as triple decker sandwiches, and inverse sandwiches. The organometallic compound can include more than one metal atom, and each metal atom can be a different a metal element, the same metal element, or a combination thereof. In an embodiment, multiple metal atoms can be bonded to one another in addition to carbon or bound only to the organic ligand portions of the sandwich compound.

In an embodiment, the ligands of the organometallic compound are the same or different. Examples of the ligand include alkyl, aryl, hydride, halide, amide, $\eta^2$-alkene, CO, CS, amine, nitrile, isocyanide, phosphane, alkylidene ($CR_2$), alkyldiide ($CR_2^{2-}$), nitrene (NR), imide ($NR^{2-}$), oxide ($O^{2-}$), alkylidyne (CR), alkyltriide ($CR^{3-}$), $\eta^3$-allyl, $\eta^3$-enyl, $\eta^3$-cyclopropenyl, NO, $\eta^4$-diene, $\eta^4$-cyclobutadiene, $\eta^5$-cyclopentadienyl, $\eta^6$-arene, $\eta^6$-triene, $\eta^7$-tropylium, $\eta^7$-cycloheptatrienyl, $\eta^8$-cyclooctatetraene, or a combination comprising at least one of the foregoing. Here, R represents a functional group selected from hydrogen, alkyl, alkoxy, fluoroalkyl, cycloalkyl, heterocycloalkyl, cycloalkyloxy, aryl, aralkyl, aryloxy, aralkyloxy, heteroaryl, heteroaralkyl, alkenyl, alkynyl, $NH_2$, amine, alkyleneamine, aryleneamine, alkenyleneamine, and hydroxyl. In addition, the organometallic compound can include various inorganic ligands, for example, $CO_2$, and CN, in their neutral or ionic forms.

According to an embodiment, the organometallic compound is a metal carbonyl. Exemplary metal carbonyls include $V(CO)_6$, $Cr(CO)_6$, $Mn_2(CO)_{10}$, $Fe(CO)_5$, $Fe_2(CO)_9$, $Fe_3(CO)_{12}$, $Co_2(CO)_8$, $Co_4(CO)_{12}$, $Ni(CO)_4$, $Mo(CO)_6$, $Tc_2(CO)_{10}$, $Ru(CO)_5$, $Ru_3(CO)_{12}$, $Rh_4(CO)_{12}$, $Rh_6(CO)_{16}$, $W(CO)_6$, $Re_2(CO)_{10}$, $Os(CO)_5$, $Os_3(CO)_{12}$, $Ir_4(CO)_{12}$, and the like. In a non-limiting embodiment, the metal carbonyl is in a liquid state such as $Fe(CO)_5$.

In an embodiment, the ligand of the organometallic compound is an unsaturated group or molecule, including, for example, $\eta^3$-allyl, $\eta^3$-(Z)-butenyl, $\eta^3$-2-methylpropenyl, $\eta^4$-2-methylidene-propane-1,3-diyl, $\eta^6$-2,3-dimethylidene-butane-1,4-diyl, $\eta^5$-(Z,Z)-pentadienyl, $\eta^5$-cyclopentadienyl (hereinafter "cyclopentadienyl" or "cp"), pentamethyl-$\eta^5$-cyclopentadienyl, $\eta^5$-cyclohexadienyl, $\eta^7$-cycloheptatrienyl, $\eta^7$-cyclooctatrienyl, 1-methyl-$\eta^5$-borole, $\eta^5$-pyrrolyl, $\eta^5$-phospholyl, $\eta^5$-arsolyl, $\eta^6$-boratabenzene, and $\eta^6$-1,4-diboratabenzene.

The ligands of the organometallic compound can be substituted a (e.g., 1, 2, 3, 4, 5, 6 or more) substituents independently selected from a halide (e.g., $F^-$, $Cl^-$, $Br^-$, $I^-$), hydroxyl, alkoxy, nitro, cyano, amino, azido, amidino, hydrazino, hydrazono, carbonyl, carbamyl, thiol, $C_1$ to $C_6$ alkoxycarbonyl, ester, carboxyl or a salt thereof, sulfonic acid or a salt thereof, phosphoric acid or a salt thereof, $C_1$ to $C_{20}$ alkyl, $C_2$ to $C_{16}$ alkynyl, $C_6$ to $C_{20}$ aryl, $C_7$ to $C_{13}$ arylalkyl, $C_1$ to $C_4$ oxyalkyl, $C_1$ to $C_{20}$ heteroalkyl, $C_3$ to $C_{20}$ heteroaryl (i.e., a group that comprises at least one aromatic ring, wherein at least one ring member is other than carbon), $C_3$ to $C_{20}$ heteroarylalkyl, $C_3$ to $C_{20}$ cycloalkyl, $C_3$ to $C_{15}$ cycloalkenyl, $C_6$ to $C_{15}$ cycloalkynyl, $C_5$ to $C_{15}$ heterocycloalkyl, or a combination including at least one of the foregoing, instead of hydrogen, provided that the substituted atom's normal valence is not exceeded.

The metal of the organometallic compound can be an alkali metal, an alkaline earth metal, an inner transition metal (a lanthanide or actinide), a transition metal, or a post-transition metal. In an embodiment, the metal of the organometallic compound is magnesium, aluminum, titanium, vanadium, chromium, manganese, iron, cobalt, nickel, zirconium, ruthenium, hafnium, tantalum, tungsten, rhenium, osmium, or a combination comprising at least one of the foregoing.

In an embodiment, the organometallic compound contains an aromatic ring such as an aryl or cyclopentadienyl group. Further, the organometallic compound can include multiple ring structures that bind to one or more metal atoms such as fulvalenediyl rings. In a further embodiment, the organometallic compound is a metallocene, for example, ferrocene, cobaltocene, nickelocene, ruthenocene, vanadocene, chromocene, decamethylmanganocene, decamethylrhenocene, or a combination of at least one of the foregoing, including dimers and oligomers thereof. As noted above, the metallocene can be substituted, e.g., as in methylcyclopentadienyl manganese tricarbonyl. In an alternative embodiment, the organometallic material can be a compound that contains a four-, five-, six-, seven-, eight-membered ring, or a combination thereof. Furthermore, the rings in the organometallic compound can be tilted so that the metal can accommodate acyclic ligands as well as more than two rings, for example, $W_2(\eta^5\text{-}C_5C_5)_2(\eta^5\text{-}C_5H_4)_2H_2$.

Metallocene compounds can be obtained commercially or synthesized. A cyclopentadienide or its derivative can be reacted with sodium to form sodium cyclopentadienide. A solution containing the transition metal, for example, a solution of the halide salt of the transition metal, can be added to the sodium cyclopentadienide to produce the metallocene. Alternatively, substituted metallocenes that are "asymmetrical," for example, metallocenes having two different cyclopentadienyl ligands, can be obtained by reacting equimolar quantities of two different cyclopentadienides. A further alternative to produce asymmetrical metallocenes is to react an unsubstituted metallocene with an alkyl halide via Friedel Crafts alkylation to produce mono- and N,N'-dialkyl substituted metallocenes in the product mixture, the former being the asymmetrical metallocene. Each metallocene can be separated via separation technique known in the art such as distillation or flash chromatography. Metallocenes containing two or more substituents in one or both of the cyclopentadienyl rings may be made as described in U.S. Pat. No. 7,030,257, the disclosure of which is incorporated herein by reference in its entirety.

In an embodiment, the organometallic compound can be disposed in the gallery of asphaltene molecules in the asphaltene particle. Upon reaction, including decomposition, the organometallic compound can provide multiple reaction products that push the asphaltene molecules away from one another in order to exfoliate an asphaltene molecule or decrease the interaction energy among constituents of the asphaltene particle.

According to another embodiment, a method for dispersing an asphaltene particle includes functionalizing an asphaltene molecule of the asphaltene particle and contacting the asphaltene particle with a solvent to disperse the asphaltene particle. Functionalization introduces a functional group to an asphaltene molecule of the asphaltene particle. In an embodiment, a surface of the polyaromatic fused ring system or an edge (i.e., a peripheral atom of the ring system) of an asphaltene molecule is functionalized to increase dispersibility and interaction of the asphaltene particle with, e.g., oil.

In certain embodiments, functionalization of the asphaltene particle includes attaching a nonpolar group to the asphaltene particle. Exemplary nonpolar groups are those that can increase the lyophilicity of the asphaltene particle in oil or aliphatic solvent. Such nonpolar groups include an alkyl group, alkenyl group, alkynyl group, aryl group, or a combination comprising at least one of the foregoing. The nonpolar groups can be attached (a) directly to the asphaltene molecule by a carbon-carbon bond without intervening heteroatoms, to provide greater thermal and/or chemical stability to the functionalized asphaltene; (b) by a carbon-oxygen bond (where the asphaltene molecule contains an oxygen-containing functional group or moiety such as hydroxy, carboxyl, and the like); or (c) by a carbon-nitrogen bond (where the asphaltene molecule contains a nitrogen-containing functional group such as amine, pyrrole, amide, and the like). In an embodiment, the asphaltene molecule can be functionalized by a metal mediated reaction with a $C_6$-$C_{30}$ aryl or $C_7$-$C_{30}$ aralkyl halide (F, Cl, Br, I) in a carbon-carbon bond forming step, such as by a palladium-mediated reaction such as the Stille reaction, Suzuki coupling, or diazo coupling, or by an organocopper coupling reaction. In another embodiment, an asphaltene molecule can be directly metallated by reaction with, e.g., an alkali metal such as lithium, sodium, or potassium, followed by reaction with a $C_1$-$C_{30}$ alkyl or $C_7$-$C_{30}$ alkaryl compound with a leaving group such as a halide (Cl, Br, I) or other leaving group (e.g., tosylate, mesylate, etc.) in a carbon-carbon bond forming step. The aryl or aralkyl halide, or the alkyl or alkaryl compound, can be substituted with a functional group such as alkyl groups (e.g., methyl, ethyl, propyl, butyl, pentyl, hexyl, octyl, dodecyl, octadecyl, and the like), aryl groups (e.g., phenyl), aralkyl groups (e.g., benzyl groups attached via the aryl portion, such as in a 4-methylphenyl group, and the like), or aralkyl groups attached at the benzylic (alkyl) position, and the like. In an exemplary embodiment, the asphaltene molecule is functionalized with an alkyl group such as a dodecyl group.

In another embodiment, the functionalized asphaltene particle can be heated. The heat is absorbed by the functionalized asphaltene molecule, causing high amplitude vibrational motion of the non-polar groups. In this manner, exfoliation of asphaltene molecules can occur by vibrational-mediated dissociation or increased spacing among the asphaltene molecules in the particle. Additionally, the heated asphaltene particles can be more miscible with solvents. Solvents include, for example, an alkane, carbon dioxide, carbon disulfide, resin, oil, or a combination comprising at least one of the foregoing. Particular solvents include, 2,2-dimethylpropane, butane, 2,2-dimethylbutane, pentane, hexane, heptane, octane, nonane, decane, unedecane, cyclopentane, cyclohexane, and the like.

According to another embodiment, functionalizing the asphaltene includes oxidizing the asphaltene to introduce an oxy group such as a hydroxy group, epoxy group, carbonyl group, carboxyl group, peroxy group, ether group, or a combination comprising at least one of the foregoing. In an embodiment, the asphaltene can be functionalized by oxidative methods to produce an epoxy, hydroxy group or glycol group using a peroxide, or by cleavage of a double bond by, for example, a metal mediated oxidation such as a permanganate oxidation to form ketone, aldehyde, or carboxylic acid functional groups. Oxidation of the asphaltene molecule can decrease the aromaticity of the molecule by breaking carbon-carbon double bonds that take part in electron delocalization, for example, in phenyl or pyrrole rings. Moreover, oxidation can deform the planar polyaromatic fused ring system within the asphaltene molecule by creating $sp^3$ hybridized carbon from carbon that was $sp^2$ hybridized in the asphaltene molecule before oxidation.

After oxidation, the asphaltene particle can be heated. Here, heating can stimulate the production of gaseous species from the oxidized asphaltene molecules. In an non-limiting embodiment, heating the oxidized asphaltene particle produces carbon oxides (CO, $CO_2$, and the like), sulfur oxides ($SO_2$, $SO_3$, and the like), nitrogen oxides (NO, $NO_2$, and the like) or a combination comprising at least one of the foregoing. The gas can force the constituent asphaltene molecules away from one another, and an asphaltene molecule can be exfoliated from the asphaltene particle. In another embodiment, a solvent or surfactant can contact the oxidized asphaltene particle and allow dispersion of the oxidized asphaltene particle, for example, in an oil. Exemplary solvents include a polar solvent, aromatic solvent, or a combination comprising at least one of the foregoing. The polar solvent can be a water, alcohol (e.g., ethanol, propanol, glycol, and the like), amine (e.g., methylamine, diethyl amine, tributyl amine, and the like), amide (e.g., dimethylformamide), ether (e.g., diethyl ether, polyether, tetrahydrofuran, and the like), ester (e.g., ethyl acetate, methyl butyrate, and the like), ketone (e.g., acetone), acetonitrile, dimethylsulfoxide, propylene carbonate, and the like. The aromatic solvent can be, for example, benzene, toluene, xylene, and the like.

The methods herein can be used to decrease oil viscosity in a reservoir, borehole, processing facility, and the like. Exfoliation of asphaltene herein can be used to extract asphaltene particles that constrict flow in, for example, a tubular, and can restore flow in a plugged reservoir. Additionally, exfoliation of asphaltenes can increase permeability in porous media and flow channels. As a result of exfoliation to decrease the number of asphaltene molecules in an asphaltene particle, oil viscosity also decreases. Lowering the viscosity of the oil improves pumping efficiency. Additionally, the detrimental effects of asphaltene can be diminished or eliminated, including alleviation of flocculates of asphaltenes that can plug a reservoir or production tubing, restrict flow in a transport line, foul a production facility, alter wettability of crude oil, or poison a refinery catalyst.

In an embodiment, a method for improving oil recovery includes disposing a reagent in an oil environment, contacting an asphaltene particle with the reagent, decomposing the asphaltene particle to produce decomposed asphaltene, and displacing the decomposed asphaltene to improve oil recovery. The asphaltene particle can be a precipitated asphaltene particle or an asphaltene particle that is disposed in a fluid (e.g., a micelle). The reagent can include an oxidizer, intercalating agent, or a combination comprising at least one of the foregoing as described above. Decomposition includes exfoliation as well as functionalization or alteration of chemical or physical property of the asphaltene particle that increases its compatibility with oil. The oil environment can be, for example, a formation, tubular, borehole, reactor, and the like.

The methods herein are further illustrated by the following non-limiting examples.

EXAMPLE 1

Crude oil including asphaltene particles is placed in a glass flask at 25° C. While stirring the contents of the flask, liquid $Fe(CO)_5$ is added drop wise. The temperature is increased to 150° C. and gas evolution is monitored. The particle size distribution of the fresh crude oil and aliquots from the flask are determined using dynamic light scattering. The peak in the particle size distribution for samples treated with $Fe(CO)_5$ shifts to lower values as compared to that of the untreated crude oil.

EXAMPLE 2

Crude oil including asphaltene particles is placed in a glass flask at 25° C. While stirring the contents of the flask, $KMnO_4$ and sulfuric acid are added drop wise, and nitric acid is added to the flask thereafter. The temperature is increased and gas evolution attributed to carbon dioxide, sulfur dioxide, and nitric oxides is observed. The particle size distribution of the fresh crude oil and aliquots from the flask are determined using dynamic light scattering. The peak of the particle size distribution for acid treated oil shifts to a lower value as compared with that of the untreated crude oil.

While one or more embodiments have been shown and described, modifications and substitutions may be made thereto without departing from the spirit and scope of the invention. Accordingly, it is to be understood that the present invention has been described by way of illustrations and not limitation. Embodiments herein are can be used independently or can be combined.

All ranges disclosed herein are inclusive of the endpoints, and the endpoints are independently combinable with each other. The suffix "(s)" as used herein is intended to include both the singular and the plural of the term that it modifies, thereby including at least one of that term (e.g., the colorant (s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like. All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity). The conjunction "or" is used to link objects of a list or alternatives and is not disjunctive, rather the elements can be used separately or can be combined together under appropriate circumstances.

What is claimed is:

1. A method for decomposing an asphaltene particle, the method comprising:

contacting the asphaltene particle with an intercalating agent; the asphaltene particle comprising a collection of asphaltene molecules held together by one or more of the following:

hydrogen bonding, dipole-dipole interactions, and p-p interactions; and separating an asphaltene molecule from the asphaltene particle to decompose the asphaltene particle;

wherein the intercalating agent comprises:

an acid comprising $H_4P_2O_7$;

an organometallic compound that includes a metallocene, metal carbonyl, or a combination comprising at least one of the foregoing;

a metal selected from the group consisting of an alkali metal, and alkaline earth metal;

a binary alloy of an alkali metal with mercury or thallium;

a ternary alloy of an alkali metal with a Group V metal; or a metal coordinated by nitrogenous compounds.

2. The method of claim 1, further comprising expanding the volume of the asphaltene particle.

3. The method of claim 1, further comprising increasing the temperature of the asphaltene particle.

4. The method of claim 3, wherein the temperature is increased to about 100° C. to about 1200° C.

5. The method of claim 3, wherein increasing the temperature comprises in-situ combustion, steam introduction, heated fluid injection, or a combination comprising at least one of the foregoing.

6. The method of claim 1, further comprising applying sonic frequencies to the asphaltene particle.

7. The method of claim 1, further comprising disposing the intercalating agent in a gallery of the asphaltene particle.

8. The method of claim 1, further comprising producing a product molecule from reaction of the intercalating agent.

9. A method for dispersing an asphaltene, the method comprising:

attaching a nonpolar group to the asphaltene; and contacting the asphaltene with a solvent to disperse the asphaltene, wherein attaching the nonpolar group to the asphaltene comprises one or more of the following: reacting the asphaltene with a $C_6$-$C_{30}$ aryl halide or a $C_7$-$C_{30}$ aralkyl halide through a metal mediated reaction; or reacting the asphaltene with an alkali metal followed by a reaction with a $C_1$-$C_{30}$ alkyl or $C_7$-$C_{30}$ alkaryl compound with a leaving group, wherein the leaving group comprises one or more of the following: Cl; Br; I; a tosylate; or a mesylate.

10. The method of claim 9, wherein the nonpolar group comprises an alkyl group, alkenyl group, alkynyl group, aryl group, or a combination comprising at least one of the foregoing.

11. The method of claim 9, wherein the solvent is a nonpolar solvent comprising an alkane, carbon dioxide, carbon disulfide, resin, or a combination comprising at least one of the foregoing.

12. A method for improving oil recovery, the method comprising:

disposing a reagent or an intercalating agent in an oil environment;

contacting an asphaltene particle with the reagent or the intercalating agent;

decomposing the asphaltene particle to produce decomposed asphaltene; and displacing the decomposed asphaltene to improve oil recovery;

wherein decomposing comprises attaching a nonpolar group to at least one asphaltene molecule of the asphaltene particle or disposing the intercalating agent in a gallery of the asphaltene particle to exfoliate the asphaltene particle, wherein the asphaltene particle comprises a collection of asphaltene molecules held together by one or more of the following: hydrogen bonding, dipole-dipole interactions, and $\pi$-$\pi$ interactions, and wherein the intercalating agent is:

an acid selected from the group consisting of sulfuric acid, acetic acid, phosphoric acid, $H_4P_2O_7$, $H_3AsO_4$, and $H_2SeO_4$;

a metal selected from the group consisting of alkali metals, alkaline earth metals, rare earth metals, and post-transition metals;

a binary alloy of an alkali metal with mercury or thallium;

a ternary alloy of an alkali metal with a Group V metal;

a metal sulfide;

a metal selenide;

a metal hydride;

a metal hydroxide;

a metal halide;

a metal coordinated by nitrogenous compounds;

a solvent selected from the group consisting of n-methylpyrrolidone; n,n-dimethylacetamide; $\gamma$-butyrolactone; 1,3-dimethyl-2-imidazolidinone; benzyl benzoate; hexafluorobenzene; and pyridine; or an organometallic compound that includes a metallocene, metal caronbyl, or a combination comprising at least one of the foregoing, wherein the oil environment is a formation or borehole.

13. The method of claim 12, wherein the intercalating agent comprises acetic acid, $H_4P_2O_7$ or a combination comprising at least one of the foregoing.

14. The method of claim 12, wherein the intercalating agent comprises a metallocene, metal carbonyl, or a combination comprising at least one of the foregoing.

15. The method of claim 12, wherein decomposing the asphaltene particle comprises disposing the intercalating agent in a gallery of the asphaltene particle.

16. The method of claim 12, wherein the intercalating agent is one or more of the following: an alkali metal; or an alkaline earth metal.

17. The method of claim 12, wherein the intercalating agent is one or more of the following: a binary alloy of an alkali metal with mercury or thallium; or a ternary alloy of an alkali metal with a Group V metal.

18. The method of claim 12, wherien the intercalating agent is one or more of the following: a metal sulfide; a metal selenide; a metal hydride; a metal hydroxide; or a metal halide.

19. The method of claim 12, wherein the intercalating agent is a metal coordinated by a nitrogenous compound.

20. The method of claim 12, wherein the intercalating agent is one or more of the following: n-methylpyrrolidone; n,n-dimethylacetamide; $\gamma$-butyrolactone; 1 ,3-dimethyl-2-imidazolidinone; benzyl benzoate; hexafluorobenzene; or pyridine.

21. The method of claim 12, wherein the intercalating agent is one or more of the following: NaI; $FeCl_3$; $CuCl_2$; $AuCl_3$; $MoCl_5$; $PbO_2$; $MnO_2$; or $As_2O_5$.

* * * * *